US005681184A

United States Patent [19]

Pamart et al.

[11] Patent Number: 5,681,184

[45] Date of Patent: Oct. 28, 1997

[54] CONNECTOR WITH SECONDARY LOCKING AND COUPLING MECHANISMS

[75] Inventors: Olivier Pamart, Domont; Jaques Lalange, Pontoise, both of France

[73] Assignee: The Whitaker Corporation, Wilmington, Del.

[21] Appl. No.: 593,219

[22] Filed: Jan. 29, 1996

[30] Foreign Application Priority Data

Feb. 9, 1995 [FR] France ..... 95 01506

[51] Int. Cl.[6] ..... H01R 13/40

[52] U.S. Cl. ..... 439/595; 439/310; 439/347

[58] Field of Search ..... 439/157, 310, 439/347, 595, 744

[56] References Cited

U.S. PATENT DOCUMENTS

| | | | |
|---|---|---|---|
| 4,332,432 | 6/1982 | Colleran | 339/75 M |
| 4,826,452 | 5/1989 | Sian et al. | 439/595 |
| 4,850,890 | 7/1989 | Kuzuno et al. | 439/310 |
| 4,875,873 | 10/1989 | Ishizuka et al. | 439/347 |
| 4,973,268 | 11/1990 | Smith et al. | 439/595 |
| 5,183,408 | 2/1993 | Hatagishi | 439/147 |
| 5,389,014 | 2/1995 | Kümpel et al. | 439/595 |
| 5,425,653 | 6/1995 | Koiso | 439/347 |
| 5,575,676 | 11/1996 | Tsukakoshi et al. | 439/347 |

*Primary Examiner*—J. J. Swann
*Attorney, Agent, or Firm*—Driscoll Niwa

[57] ABSTRACT

A connector comprises a housing for receiving terminals therein, a secondary locking member mountable thereto and a linear bayonet type of slide-lock member to assist coupling of the connector to a complementary connector. In the preassembly position, the slide lock member is in a fully closed position where shoulders engage with latches of the secondary locking member which is in the preassembly position allowing reception of terminals in cavity of the connector housing. When the secondary locking member is depressed into its fully locked position, the latches disengage from the shoulders of the slide-lock member, thus allowing it to be opened to enable coupling to the complementary connector. Due to the slide-lock member being in a fully closed position when the secondary locking member is in a preassembly position, coupling between the connector with a complementary connector is prevented, and in particular not even partial coupling is allowed as the complementary connector studs cannot engage in the camming slots at all.

11 Claims, 3 Drawing Sheets

CONNECTOR WITH SECONDARY LOCKING AND COUPLING MECHANISMS

BACKGROUND OF THE INVENTION

1. Field of the Invention

This invention relates to an electrical connector having a secondary locking mechanism for locking terminals within cavities of the connector, further comprising a coupling member for assisting coupling of the connector to a complementary connector, whereby the coupling member interengages with the secondary locking member to prevent coupling if the secondary locking member is not in its fully locked position.

2. Description of the Prior Art

It is common, in the automotive industry for example, to provide connectors with secondary locking mechanisms that cooperate with primary terminal locking means to ensure that terminals are fully mounted and secured in cavities of the connector housing. It is also known to provide connectors with slide-lock coupling mechanisms that assist the coupling of complementary connectors, in particular by reducing the forces required to couple the connectors by means, for example of a lever arm or cam mechanism. The slide-lock coupling mechanism usually has the additional function of locking the coupled connectors together, so that they cannot separate even under vibration or other forces.

It is often desirable to re-unite these functions in a single connector, such that coupling between complementary connectors is made only when the secondary locking mechanism is fully locked to the housing thereby ensuring that the terminals are fully assembled and locked within cavities of the connector housing. It is a continuous requirement in most industries to provide more cost-effective connectors which are also more reliable, not only during connection, but also that ensure a more reliable assembly.

It is therefore desirable to provide an electrical connector with a secondary locking mechanism and with a coupling assist mechanism, such connector being cost-effective to manufacture yet ensuring that the connector cannot be coupled to a complementary connector unless the terminals are fully assembled to the connector and securely locked therein by the secondary locking mechanism, in a reliable manner.

SUMMARY OF THE INVENTION

It is therefore an object of this invention to provide an electrical connector with secondary locking and coupling assist mechanisms that interengage to prevent coupling to a complementary connector if the secondary locking mechanism is not in the fully locked position, in a cost-effective and reliable manner.

It is a further object of this invention to provide an electrical connector with secondary locking and coupling assist mechanisms that preferably precludes even partial coupling to a complementary connector unless terminals are fully assembled and secured to the connector, in a cost effective and reliable manner.

The objects of this invention have been achieved by providing an electrical connector comprising a housing with cavities for receiving electrical terminals therein, a secondary locking member mountable to the housing in a first preassembly position where the terminals can be inserted into the housing cavities, and movable to a second fully locked position where the terminals are securely locked in the cavities thereby, the connector further comprising a slide-lock mechanism for gripping a complementary connector and drawing the complementary connector in mating condition with the connector when moved from an open to a closed position. In a preferred embodiment the slide-lock coupling member has a shoulder engageable with resilient latches of the secondary locking member when the secondary locking member is in the preassembled position and the slide-lock member is in the closed position, to prevent movement of the slide-lock member to the open position for receiving a complementary connector. When the secondary locking member is moved to the fully locked position, the latches disengage with the slide-lock member shoulder thereby allowing movement thereof to the fully open position for receiving the complementary connector. It is thus ensured that the connector can only be coupled to a complementary connector when the secondary locking member is fully assembled, further ensuring that no electrical contact between the complementary connectors can be made by preventing even partial coupling of the connectors.

In another embodiment however, when the secondary locking member is in the preassembled position the slide-lock member could be in the open position but locked there by interengagement with the secondary locking member to prevent movement to the closed position and therefore prevent coupling to a complementary connector. In this case partial coupling may occur between connectors, which may be acceptable for certain applications.

DETAILED DESCRIPTION OF THE PREFERRED EMBODIMENT

Figure 1:
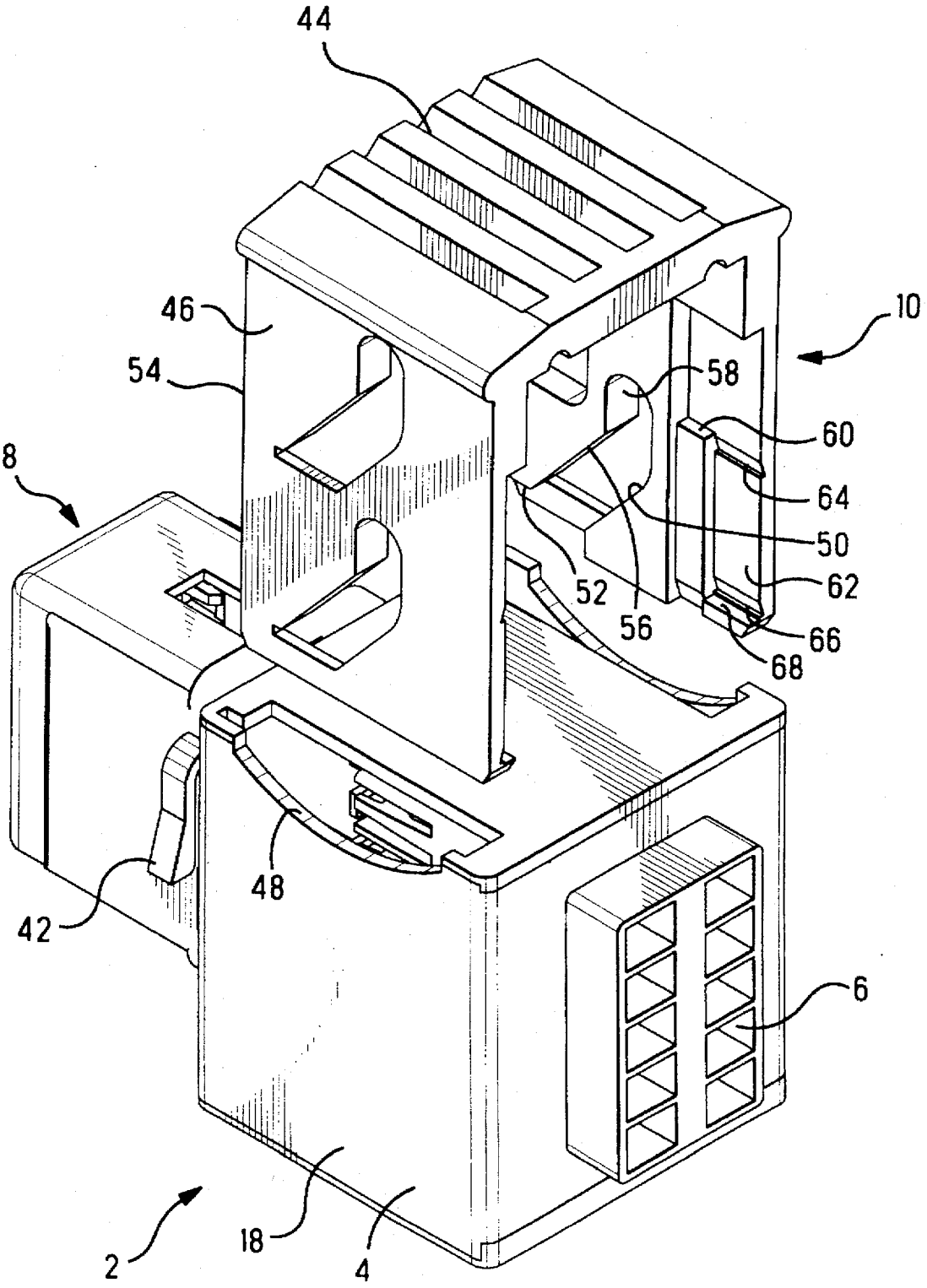
FIG. 1 is an isometric view of an embodiment of this invention with secondary locking and slide-lock coupling members exploded away.

Referring to FIG. 1, an electrical connector 2 comprises an insulative housing 4 having cavities 6 for receiving electrical terminals therein, a secondary locking member 8 and a slide-lock coupling member 10.

Figure 2:
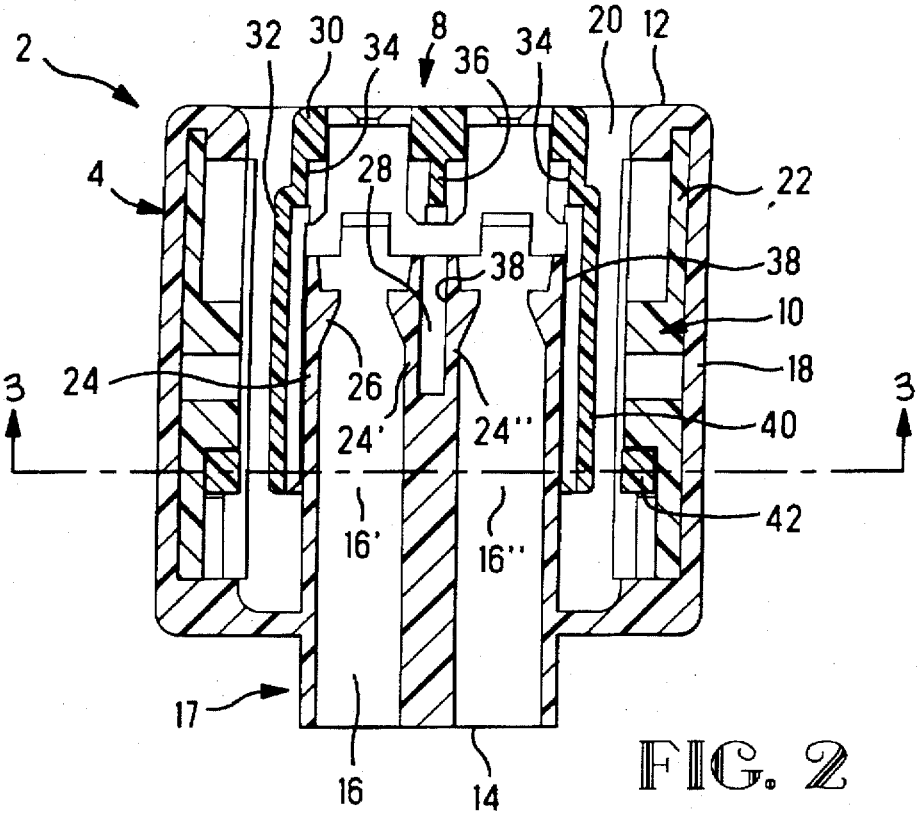
FIG. 2 is a cross-sectional view through the connector with the slide-lock coupling member in a fully locked position and the secondary locking member in a preassembled position.
Figure 3:
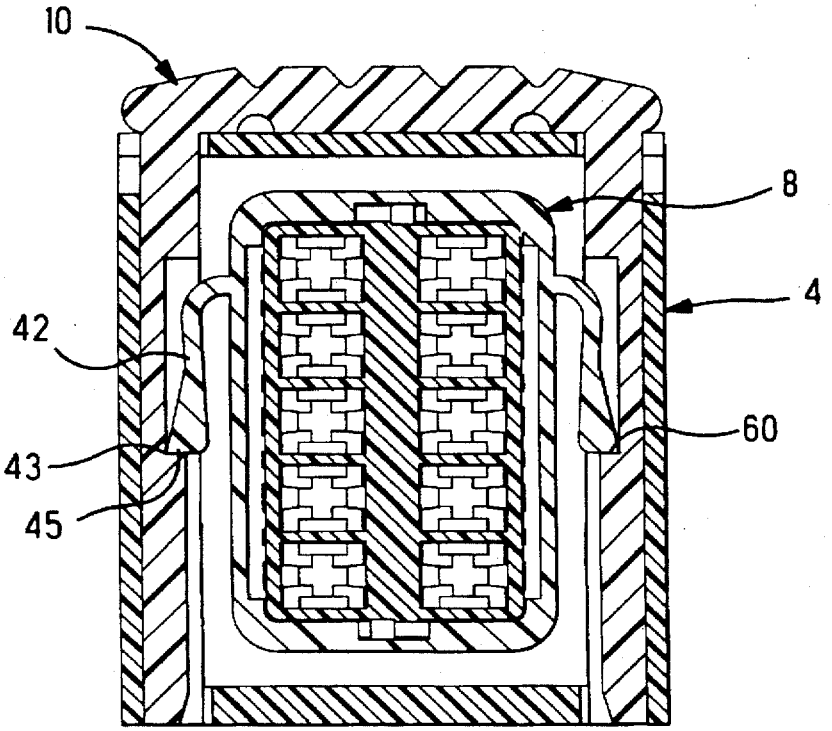
FIG. 3 is a cross-sectional view through lines 3—3 of FIG. 2.

Referring to FIGS. 1–3, the housing 4 extends between a mating face 12 and a terminal receiving face 14, the housing having a terminal receiving section 17 which is surrounded by a shroud 18 and separated therefrom by a cavity section 20 within which the secondary locking member 8 and arms 22 of the slide-lock coupling member 10 are received. The housing terminal section 17 comprises resilient locking lances 24 integrally moulded therewith, the locking lances 24 in the shape of cantilever beams and having locking protrusions 26 proximate their free ends that project into the terminal receiving cavities 16. Electrical terminals can be inserted into the cavities 16 whereby passage of the terminals past the locking lance protrusions 26 causes resilient outward biasing of the locking lances until engagement of the protrusions 26 behind shoulders of the terminals to prevent removal of the terminals from their corresponding cavities 16 towards the terminal receiving end 14. Adjacent locking lances 24',24" of adjacent cavities 16',16" are separated by a slot 28 to allow outward biasing of the lances during mounting of the electrical terminals within their corresponding cavities.

Figure 4:
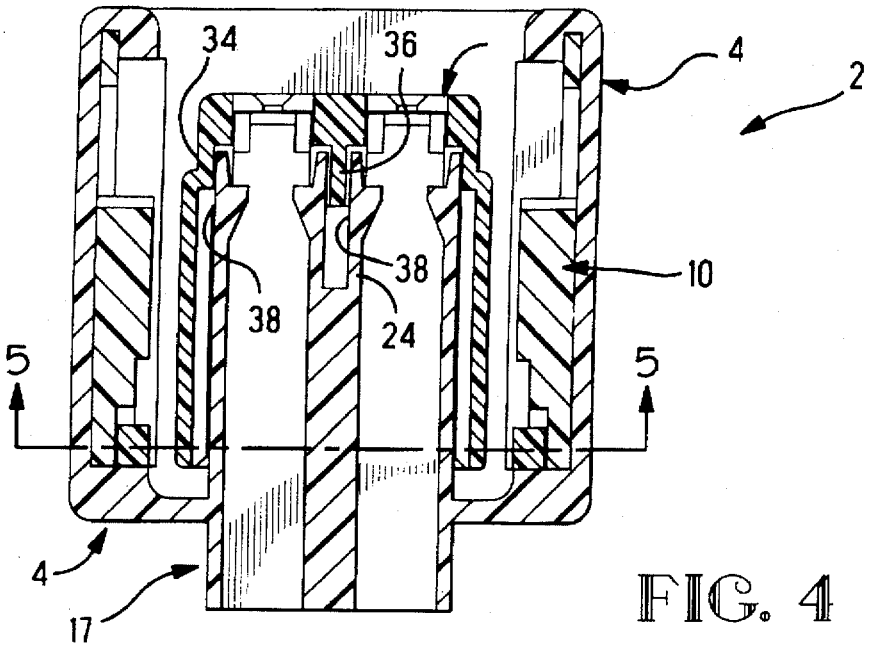
FIG. 4 is a similar view to that of FIG. 2, but with the slide-lock member in a fully open position and the secondary locking member in a fully locked position.

The secondary locking member 8 comprises a mating end wall 30 and extending therefrom a shroud 32 that fits over the mating end of the housing terminal receiving section 16. Also extending from the mating end wall 30 are short wall portions 34,36 that are positioned adjacent outer surfaces 38 of the locking lances 24 when the secondary locking housing 8 is in the fully locked position with respect to the housing 4 as shown in FIG. 4. The wall portions 34,36 thus prevent outward biasing of the locking lances 24,24',24" in order to securely lock the terminals that have been inserted into the cavity 16 and that have engaged with the locking protrusions 26 of the locking lances 24. In FIG. 2, the secondary locking housing 8 is shown in the preassembly position whereby the wall portions 34,36 are disengaged from the locking lances outer surfaces 38 such that the locking lances are free to bias outwardly for reception of terminals within the cavity 16. The secondary locking housing is held in the preassembly position by a latching means (not shown) which maintains the member 8 in the preassembly position, the secondary locking member however being depressible under application of a certain force for snapping into the fully locked position as shown in FIG. 4 where the latch means securely hold the secondary locking member in this position.

The secondary locking member 8 further comprises cantilever beam spring arms 42 attached to a lower portion 40 of the shroud 32, the cantilever beam extending in a direction perpendicular to the longitudinal direction of the terminal receiving cavity 60 (the longitudinal direction being the direction of coupling of the connector).

Figure 5:
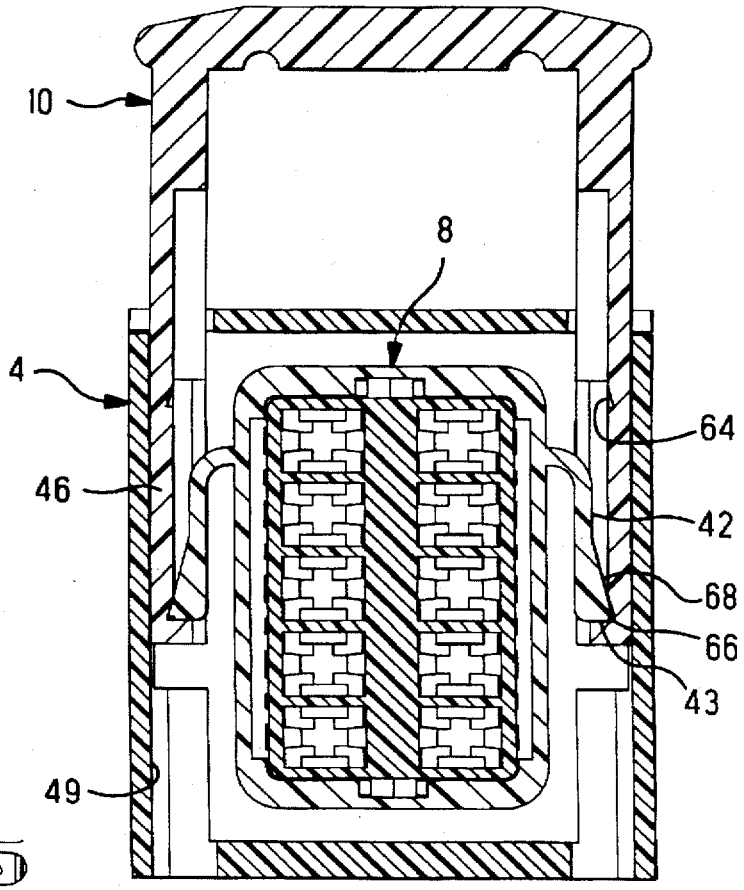
FIG. 5 is a cross-sectional view through lines 5—5 of FIG. 4.

Referring to FIG. 1, the slide-lock coupling member 10 comprises a U-shaped body having a base wall 44 and side walls 46 extending laterally therefrom, the side walls 46 insertable through cutouts 48 in the connector housing shroud 18 to slide adjacent an inner surface 49 of the side walls 18 (also see FIG. 5). The slide-lock coupling member side walls 46 comprise camming slots 50 that have a first longitudinal portion 52, extending from a complementary connector receiving end 54, the longitudinal portion 52 extending into an oblique portion 56 which then extends into a portion orthogonal to the longitudinal direction (where the longitudinal direction is the direction of coupling of the connector 2 to a complementary connector). The camming slots 50 are for receiving studs of a complementary connector (not shown), in order to draw the complementary connector towards the connector 2 when the slide-lock coupling member 10 is moved from the open position as shown in FIG. 5 to the closed position as shown in FIG. 3. The latter thus causes coupling of the connector 2 to the complementary connector. Before sliding from the open to the closed position, the slide-lock coupling member 10 receives the studs of the complementary connector first into the longitudinal portion 52 of the camming slot 50, which allows initial engagement of the connector to the complementary connector. If the slide-lock coupling member 10 is in the closed position prior to coupling to the complementary connector, the studs of the complementary connector cannot enter into the camming slot lead-in portion 52 and simply abuts the complementary connector receiving end 54 of the side walls 46, thus preventing coupling of the connectors. The end portion 58 of the camming slots 50 is contiguous with the complementary connector studs when the slide-lock coupling member 10 is in the fully closed position, and due to the orthogonal direction of the portion 58 with respect to the coupling direction of the connectors, a force tending to pull apart the connectors will not produce a force component in the orthogonal direction and thus cannot open the slide-lock member and release the connectors from the mating position.

The slide-lock member 10 further comprises a preassembly locking shoulder 60 (see FIGS. 1 and 3) on the inner surface of the side walls 46, against which latching protrusions 43 at free ends 45 of the secondary locking member spring arms 42 engage, when in the preassembly position as shown in FIG. 3. During assembly of the terminals into the housing cavities 16, the secondary locking member 8 is in the preassembly position and the slide-lock member 10 is in the fully closed position as shown in FIG. 3, whereby the spring arm protrusions 43 engage with the shoulder 60. The slide-lock member 10 can thus not be moved into the open position and can therefore not be coupled to a complementary connector.

It would also be possible to have an embodiment where the slide-lock member is locked in the open position by engagement with the secondary locking member to prevent coupling, rather than locked in the closed position as shown in the embodiment of FIGS. 1–5.

Adjacent the shoulder 60 extends a recess 62 having a closed position notch 64 extending proximate the shoulder 60 and a preassembly position notch 66 proximate ends of the side walls 46 distant from the end wall 44. Proximate the open position notch 66 is a retention shoulder 68 for engagement with the spring beam latching protrusions 43 to prevent removal of the slide-lock member 10 from the housing 4 as shown in FIG. 5. When the secondary locking member 8 is moved from the preassembly position shown in FIG. 2 to its fully locked position shown in FIG. 4, the spring beam protrusion 43 disengages from the shoulder 60 and moves into the recessed area 62 to engage in the closed position notch 64. The notch 64 engages with the latching protrusion 66 to provide a certain resistance to moving the slide-lock member 10, but if sufficient force is applied to the slide-lock member, it can be drawn to the open position as shown in FIG. 5 where the latch protrusion 43 engages in the open position notches 66 for provisionally holding the slide-lock member in the open position. The connector 2 can thus be coupled to the complementary connector and the slide-lock member 10 is then depressed to the fully closed position, thereby drawing the connectors together and coupling them. In the closed position, the slide-lock member 10 is latched with a certain force by engagement of the notches 64 with the spring beam latch protrusions 43.

The invention as described above is also applicable to a circular connector, where the slide-lock member rotates during coupling. Such a slide-lock member could for example be mounted to the connector housing shroud be inserted from the mating end, where the side walls 46 would be replaced by a cylindrical member insertable adjacent the inner surface of the connector housing shroud.

Advantageously therefore, the connector 2 cannot be coupled to a complementary connector unless the secondary locking member is correctly locked to the connector housing. In a preferred embodiment prevention of coupling is done by maintaining the slide-lock coupling member in a fully closed position thereby ensuring that not even partial coupling can occur between the connectors. A reliable means of detecting incorrect assembly is thus ensured.

We claim:

1. An electrical connector comprising a housing with cavities extending therethrough for receiving electrical terminals therein, a secondary locking member mountable to the housing in a first preassembly position where the terminals can be inserted into their corresponding cavities and movable to a fully locked position to securely lock the terminals in their corresponding cavities, the connector further comprising a slide-lock coupling mechanism to assist coupling of the connector to a complementary connector by movement of the slide-lock member from an open position where the complementary connector is received to a closed position where the connectors are coupled, characterized in that the slide-lock coupling member and secondary locking member have interengageable shoulder and latch members that engage each other when the secondary locking member is in the preassembly position to prevent movement of the slide-lock member (10) for coupling, the latch members being disengaged when the secondary locking member is in the fully locked position to allow movement of the slide-lock member for coupling.

2. The connector of claim 1 characterized in that the slide-lock member is in the closed position when the shoulder and latch members engage each other.

3. The connector of claim 1 characterized in that the slide-lock member comprises side walls having camming slots therein for receiving complementary studs of the complementary connector, the camming slots for drawing the complementary connector towards the connector by camming engagement with the studs.

4. The connector of claim 3 characterized in that the shoulder is on the side wall of the slide-lock member, and the latch member on the secondary locking member.

5. The connector of claim 1 characterized in that the secondary locking member is mountable over a mating end of a terminal receiving section of the connector housing.

6. The connector of claim 5 characterized in that the connector housing comprises resilient locking lances with protrusions engageable with the terminals for locking thereof within the cavities, the locking lances having outer surfaces, wherein the secondary locking member has wall portions engaged against the outer surfaces when in the fully locked position, and disengaged from the outer surfaces when in the preassembled position to respectively, allow resilient biasing of the lances for insertion of the terminals in the cavities, and secure locking of the terminals therein by preventing outward resilient biasing of the lances.

7. The connector of claim 1 characterized in that the slide-lock member comprises a recess extending orthogonally to the longitudinal direction and adjacent the shoulder, for receiving the latch member thereagainst to allow movement of the slide-lock member in the orthogonal direction.

8. The connector of claim 7 characterized in that the recess comprises notches at the open and closed positions for holding the slide-lock member at those positions with a certain limited force, by engagement with a protrusion of the latch member.

9. The connector of claim 1 characterized in that the latch member is a resilient beam with a protrusion thereon for engagement with the shoulder.

10. The connector of claim 3 characterized in that the secondary locking member is positioned between the side walls but spaced therefrom by a gap for receiving the shroud of the complementary connector on which the studs are attached.

11. The connector of claim 10 characterized in that the side walls extend from opposing ends of a base wall that serves as a depressor/puller for actuation of the slide-lock movement, such movement being orthogonal to the direction of coupling of the connector.

* * * * *